US006742565B2

(12) United States Patent
Badley

(10) Patent No.: US 6,742,565 B2
(45) Date of Patent: Jun. 1, 2004

(54) COVERED FRAME METHOD AND APPARATUS

(76) Inventor: Ron Badley, 364 Hillcrest Dr., Reno, NV (US) 89509

( * ) Notice: Subject to any disclaimer, the term of this patent is extended or adjusted under 35 U.S.C. 154(b) by 0 days.

(21) Appl. No.: 10/262,419

(22) Filed: Sep. 30, 2002

(65) Prior Publication Data

US 2004/0060671 A1 Apr. 1, 2004

(51) Int. Cl.[7] ..... E06B 3/30
(52) U.S. Cl. ..... 160/378; 160/381; 52/656.7
(58) Field of Search ..... 160/371, 378, 160/381; 52/656.7, 656.9; 29/448, 449; 38/102.1

(56) References Cited

U.S. PATENT DOCUMENTS 1,760,612 A * 5/1930 Trott ..... 160/216
2,128,489 A * 8/1938 Lang ..... 160/381
6,108,997 A * 8/2000 Blais et al. ..... 52/656.7

* cited by examiner

*Primary Examiner*—Blair M. Johnson
(74) *Attorney, Agent, or Firm*—Herbert C. Schulze

(57) ABSTRACT

This is a method and kit for making window coverings and frames and the like in which a multiplicity of frame members are held in position in a geometric shape and distorted inwardly towards a center of the frame by a distorting force after which a covering is adhered to the frame. When the covering is firmly adhered, the distorting force is released causing tension to be applied to the covering and insuring that the covering is taut and wrinkle free.

2 Claims, 3 Drawing Sheets

COVERED FRAME METHOD AND APPARATUS

CROSS REFERENCE TO RELATED PATENT APPLICATIONS

There are no Pending Patent Applications Filed by me related to the within Application.

BACKGROUND OF THE INVENTION

I. Field of the Invention

This invention is in the general field of protective and/or insulating devices and/or coverings for windows, panels, and segments, or the like in buildings and methods of manufacture and placement of such;

The invention is even more particularly in the fields of unique, novel, and useful tools, jigs, fixtures and the like for such devices and for the practice of the methods;

The invention is most particularly in the fields of such devices, methods, tools and the like which are usable by unskilled individuals and without special training.

II. Description of the Prior Art

I have searched through publications, commercial publications, technical works, builders supply facilities and patent files.

I know of no prior art which truly accomplishes the advantages and purposes of my invention as will be detailed below. Until now, there have been some efforts to make window coverings and the like by fastening a film or the like to a framework by the well known spline/groove system wherein attempts are made to fasten film into a frame having a groove into which an edge of a panel of covering material such as screen or other covering is forced into a groove around a frame by a tightly fitting bead of material. This generally results in an unsightly product which is wrinkled and with imperfect holding of the film by the spline in the groove. Another attempt which is sometimes made is the use of complex interlocking systems. All such systems are very labor intensive, costly, and unattractive.

I have studied publications, commercially available systems and materials, builders guides, patent files, and installed windows and the like and I have been unable to find any prior art which suggests or anticipates my present inventions.

My system which is described below approaches the problem in an innovative and novel manner which is not suggested nor anticipated in any way and results in the most economical, practical, innovative, novel, useful and attractive product for covering windows and the like and for the purposes set forth.

SUMMARY OF THE INVENTION

During cold weather homeowners and others are uniformly presented with the need to prevent heat within a house or other building from escaping. During warmer weather the same persons are presented with the reverse problem of preventing heat from entering the building.

Such persons do many things to try to conserve the energy which is lost in maintaining desirable temperatures within their buildings. Insulation is installed within walls and in attics and the like, double pane windows and insulated doors are utilized, and various other attempts are made which are known to those skilled in the art. No matter what is tried, even when double pane windows are used, there is serious loss of energy through windows, some panels, decorative features, and the like.

I have mentioned above the attempts to provide coverings for windows and the like, which attempts are unsatisfactory for the reasons indicated.

Because the problem is so important, I devoted a great deal of time and money in attempts to alleviate the heat transfer problems at windows and the like. I came to the conclusion that the only way to accomplish the desired results was with a frame having a properly sealed attractive transparent covering.

On studying frame materials available I found that hollow extruded frame material usually has a natural bow of a few degrees. Using this knowledge I concluded that I might utilize that natural bow by reversing it and holding it formed into a rectangular frame, firmly attaching a film or the like to the frame and then releasing the hold on the frame to allow the frame members to attempt to revert to the natural bow, thus stretching the film tightly.

I then proceeded to make special fixtures to hold the frame material properly so that was a reverse bowing action whether or not the extruded material had a natural bow. I then applied double stick adhesive tape to the frame material, placed film over the tape, trimmed the film, released the frame from the fixtures, and found that I had the perfect window covering to accomplish the desired result of an attractive, efficient, economical thermal barrier.

I found a further use for this system in that I have now been able to apply the basic principles to window screens and the like. This allows anyone, whether skilled or not, to economically make perfect window coverings of virtually any type and for any purpose.

It is an object of this invention to provide a method of forming attractive and useful thermally insulating widow coverings and the like;

Another object is to provide thermally insulating window coverings which are easily installed;

Another object is to provide such window coverings which can be made by an unskilled person;

Another object is to provide a kit which enables a homeowner or the like to make such window coverings on site;

Another object is to provide such window coverings which remain rigid and taut due to natural tensions built into them.

The foregoing and other objects and advantages of this invention will become apparent to those skilled in the art upon reading the following description of a preferred embodiment in conjunction with a review of the appended drawings.

DESCRIPTION OF A PREFERRED EMBODIMENT

Figure 1:
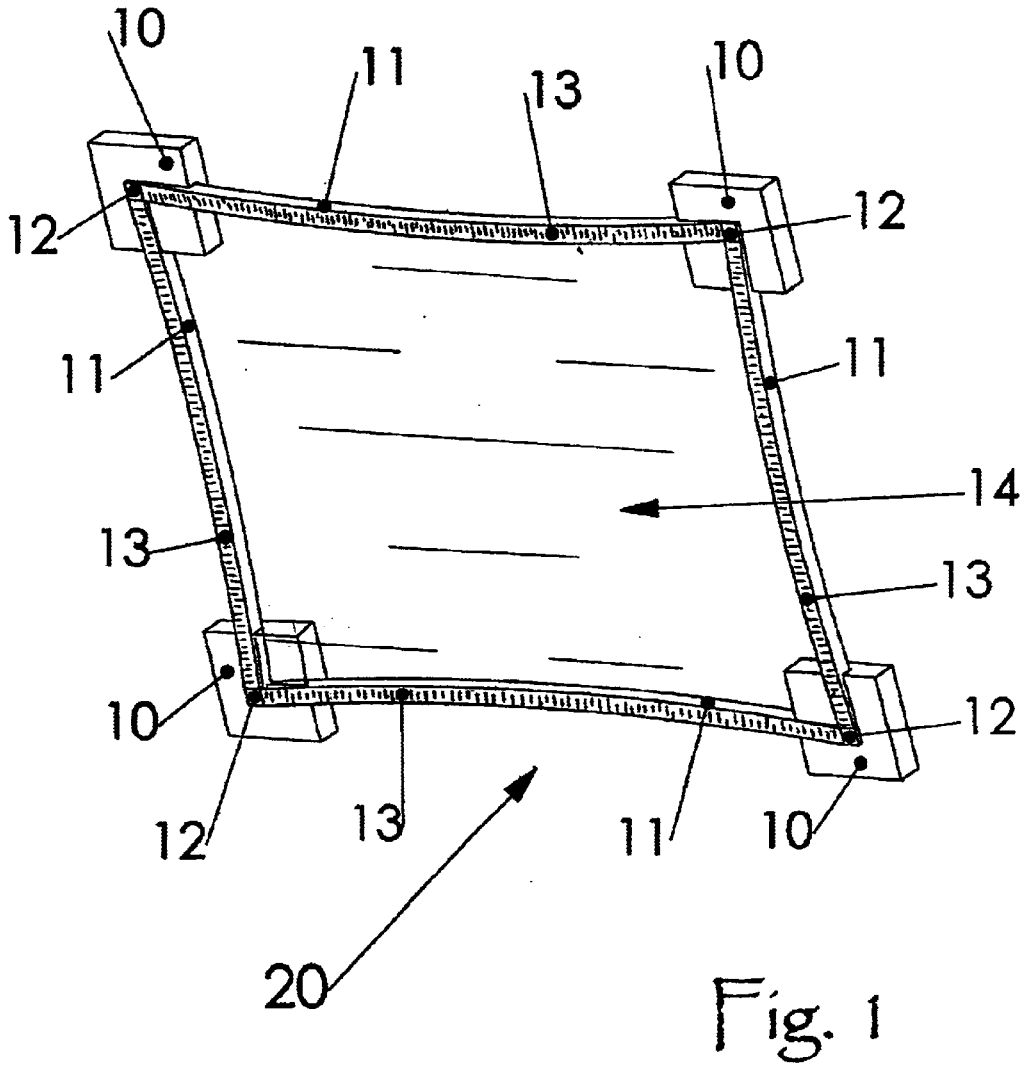
FIG. 1 is a schematic perspective of a window cover suitable to practice the methods of this invention, made by the methods of this invention and held by fixtures of this invention.
Figure 2:
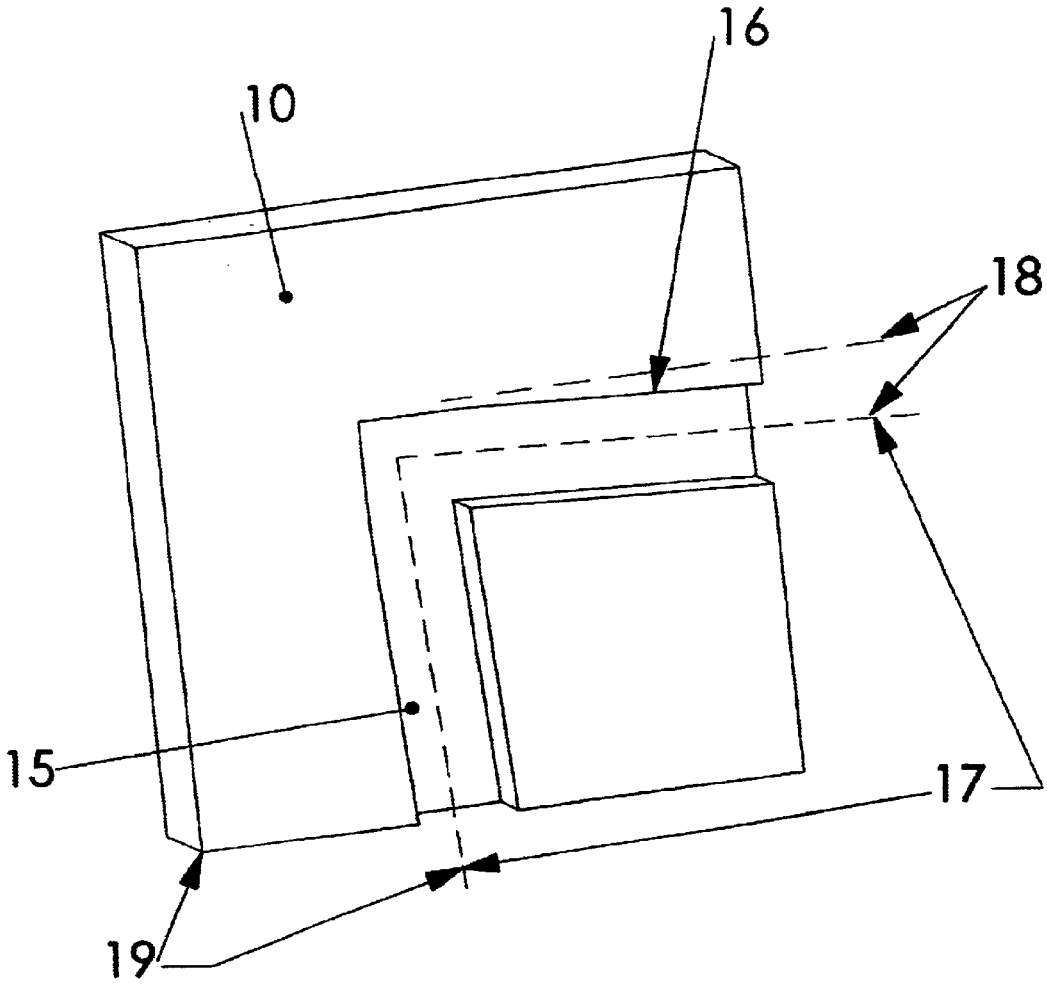
FIG. 2 is a schematic perspective of a fixture used in practicing a method of this invention.

An inventory of the items on the drawings bearing reference numerals is:

| Numeral | Item |
|---|---|
| 10 | corner fixture |
| 11 | frame member |
| 12 | corner connector |
| 13 | double stick tape |
| 14 | film |
| 15 | groove in fixture |
| 16 | groove in fixture |
| 17 | angle between grooves |
| 18 | angle of groove from horizontal |
| 19 | angle of groove from vertical |
| 20 | covered frame |
| 21 | joinder element |

FIG. 1 illustrates a window covering constructed by the methods of this invention immediately after construction and while still in place upon the fixtures used in its construction. The covering is preferably constructed from four segments 11 of aluminum window screen frame material or the like which is well known to those skilled in the art. However, the frame may be constructed from any suitable framing material even including strips of wood. The only absolute requirement is that the framing material must be capable of a slight amount of flexing and must be capable of adhering to double stick tape or other suitable adhesive.

Four lengths of frame material 11 are joined at their ends by connectors 12 to form a generally rectangular frame as shown. Each of the four frame members is held in connection with two other frame members 11. The connectors 12 are well known to those skilled in the art and are commonly used to connect lengths of window screen material. The four fixtures 10 are merely blocks of wood or the like having two grooves, or channels 15 and 16 at an angular relationship 17 which is less than ninety degrees. The exact angular relationship which will cause the best effect may be easily determined empirically by those skilled in the art to suit the exact materials being used. I have found that an angular relationship 17 of about eighty-six degrees is generally effective. This angular relationship causes an inward bowing of the frame elements 11, which may be augmented by any natural bowing of the frame members in the opposite direction.

The four fixtures 10 should be placed on a table or other base object. The frame is then distorted slightly and placed into the fixtures. Double stick tape or other suitable adhesive 13 is applied to the frame. For best results the adhesive material should be stable under ultra violet exposure. A film of clear vinyl (I have found 20 mil to generally be a desirable thickness) or the like 14 covers the entire frame and is pressed against the adhesive material to assure full adhesion. The film is preferable larger than the outer perimeter of the frame members 11 when applied. After adhering to the adhesive, excess film is trimmed by a knife or the like.

Figure 3:
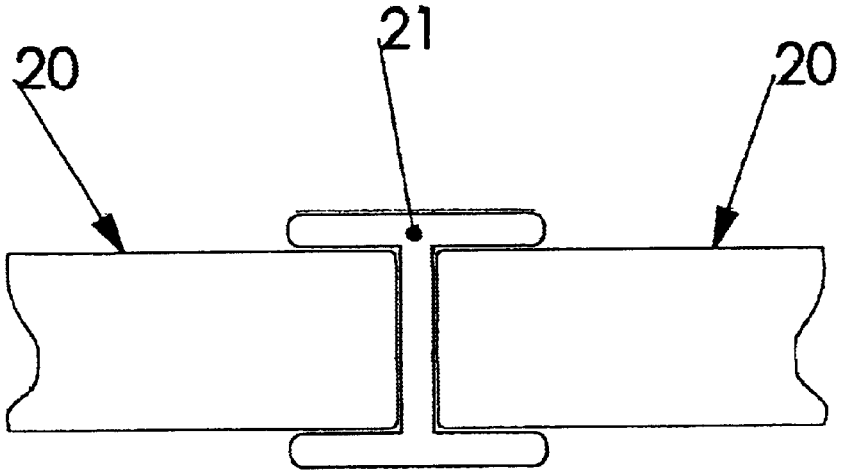
FIG. 3 is a schematic representation of a joinder of multiple covers.

The frame with the adhering film forms the complete window covering device 20 which is then removed from the fixtures. Because of the inward bowing, when the device 20 is removed from the fixtures the film becomes taut and there is no wrinkling or sagging. For large windows or the like, a number of devices 20 may be joined by using double channel joinder elements 21 as indicated in FIG. 3.

I have mentioned 20 mil vinyl film, and other materials. I have illustrated a rectangular device 20. I may have made other specific mentions of materials, shapes, or the like. Such are for purposes of illustration only. For example, other shapes such as hexagon or octagon and the like might be constructed in this manner. Likewise, other film materials such as screen, canvas, paper and the like might be employed. Also other uses of the devices formed according to the teachings herein might be found such as for picture frames, trays, and the like which will be understood by those skilled in the art. It is understood that this method may be performed by hand or may be automated.

By this reference I incorporate the claims and abstract which follow in this specification and in this description of a preferred embodiment the same as though I had repeated them here.

In the claims which follow if I should fail to claim a patentable feature of this invention and disclosure such failure to claim will be due to inadvertence and not to any intent to dedicate or abandon such feature.

While the embodiments of this invention shown and described are fully capable of achieving the objects and advantages desired, such embodiments have been mentioned for purposes of illustration only and not for purposes of limitation.

I claim:

1. A method for providing a frame with a wrinkle resistant covering comprising: forming a frame of flexible material into a geometric shape; distorting said frame inwardly; adhering a covering over the distorted frame; and releasing the distortion so as to cause the covering to be under tension, wherein the distortion is caused by placing adjoining frame members into removable corner fixtures in such a manner that the interior angular relationship of each corner is less than ninety degrees causing each frame member to bow slightly inwardly; and the adhering of the covering is by placing one adhesive side of double stick tape to one side of each frame member and adhering a sheet of vinyl film which is larger than said frame to the other side of said double stick tape; and the release of distortion is caused by removing the corner fixtures from the frame corners after which excess vinyl sheet material is trimmed from the outer perimeter of said frame.

2. A frame making kit comprising a multiplicity of frame members joinder fixtures configured so as to bow inwardly the multiplicity of frame members when joined into a rectangular shape, wherein each of the frame member joiner fixtures is a removable device suitable to temporarily hold two joined frame members of a substantially rectangular frame in a relationship wherein the inner angular relationship of the two joined frame members is less than ninety degrees, and wherein the kit includes double stick tape sufficient to cover one side of the rectangular frame.

* * * * *